US005469794A

United States Patent [19]

Laderoute et al.

[11] Patent Number: 5,469,794

[45] Date of Patent: Nov. 28, 1995

[54] RAIL MOUNTED TABLE ROTATABLE ABOUT A LONGITUDINAL EDGE

[76] Inventors: Richard Laderoute; Lynn Sasser, both of 266 St Michaels Cir., Odenton, Md. 21113

[21] Appl. No.: 222,079

[22] Filed: Apr. 1, 1994

[51] Int. Cl.[6] ..... A47B 5/00

[52] U.S. Cl. ..... 108/48; 108/38

[58] Field of Search ..... 103/48, 42, 47, 103/152

[56] References Cited

U.S. PATENT DOCUMENTS

| | | | |
|---|---|---|---|
| 1,208,885 | 12/1916 | Alderman et al. | 108/88 X |
| 2,650,145 | 9/1953 | Sieminski | 108/48 |
| 3,062,544 | 11/1962 | Viets | 108/38 X |
| 3,736,884 | 6/1973 | Kohnsk | 108/48 |
| 5,197,381 | 3/1993 | Mells | 108/48 X |

FOREIGN PATENT DOCUMENTS

| | | | |
|---|---|---|---|
| 2491407 | 4/1982 | France | 108/48 |
| 934881 | 8/1963 | United Kingdom | 108/48 |
| 1540576 | 2/1979 | United Kingdom | 108/48 |

*Primary Examiner*—José V. Chen

*Attorney, Agent, or Firm*—Peter Gibson

[57] ABSTRACT

A table attached along the edge of one longitudinal side by hinges to a horizontally disposed rail which is intended for attachment to a substantially vertical structure possesses two legs each attached by a hinge to the table proximate either opposed corner of the table distal the edge attached to the rail. Both legs are mounted to: (a) support the table in a utility position with each leg being disposed perpendicular to the substantially planar bottom table surface and (b) to be disposed substantially flush to the bottom table surface in a closed position thereby allowing the table to be rotated about the horizontal, longitudinal hinges to a vertical position hanging from the rail by means of said hinges. The length of each leg is substantially equivalent to the distance between the floor and the hinged longitudinal and horizontal rail attachment. The hinges for holding the legs in both closed and open positions lock in either position. The longitudinal orientation of the table with respect to the rail optimizes the use of space in manner areas including a typical residential exterior deck and accommodates seating facing the rail which in the case of an exterior deck is outward over a railing. The vertical storage position enables the full use of the area in which the table is located, protects the upper table surface from precipitation in exterior applications and minimizes maintenance.

15 Claims, 3 Drawing Sheets

FIG 5
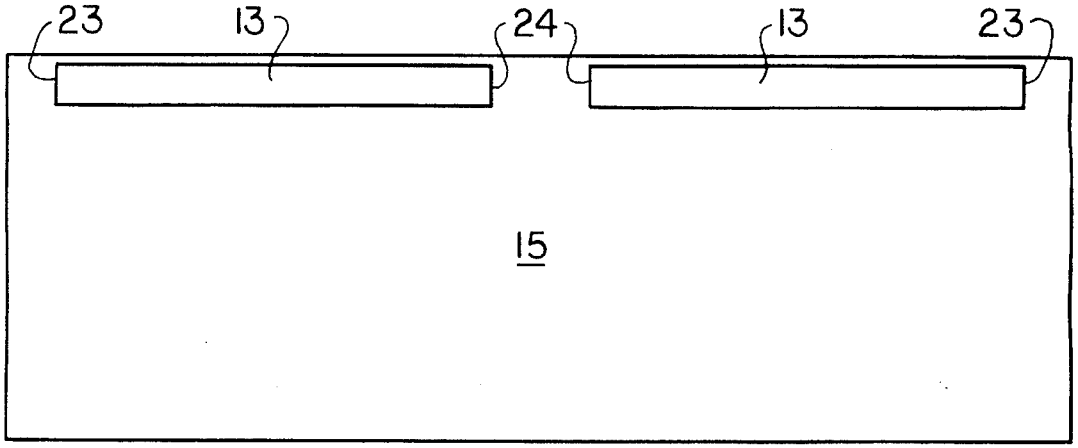
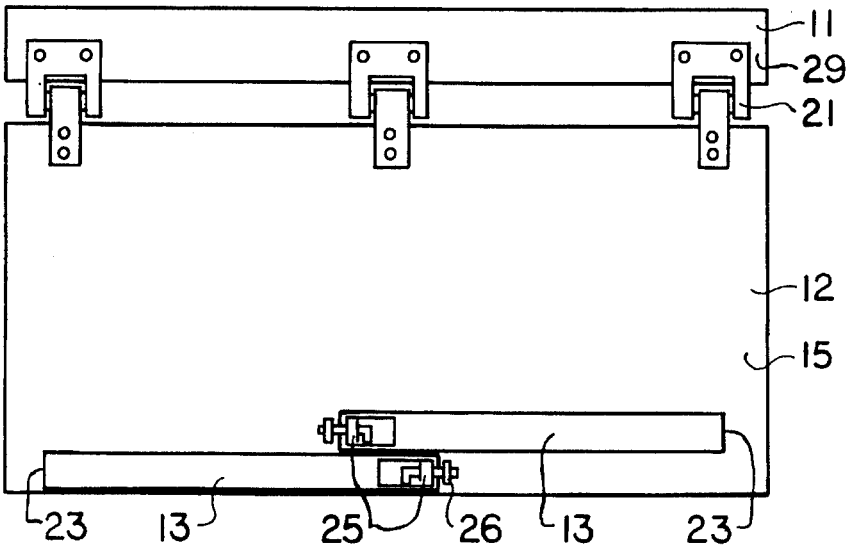
FIG 4
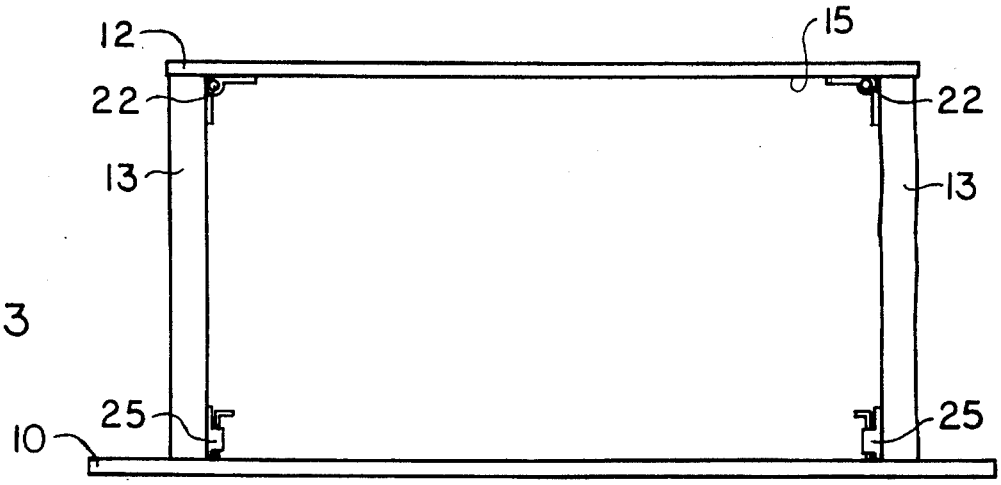
FIG 3

FIG 6
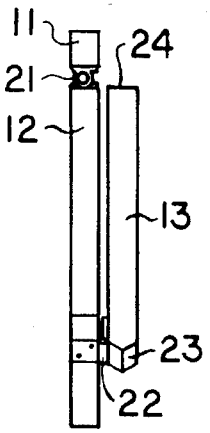
FIG 7
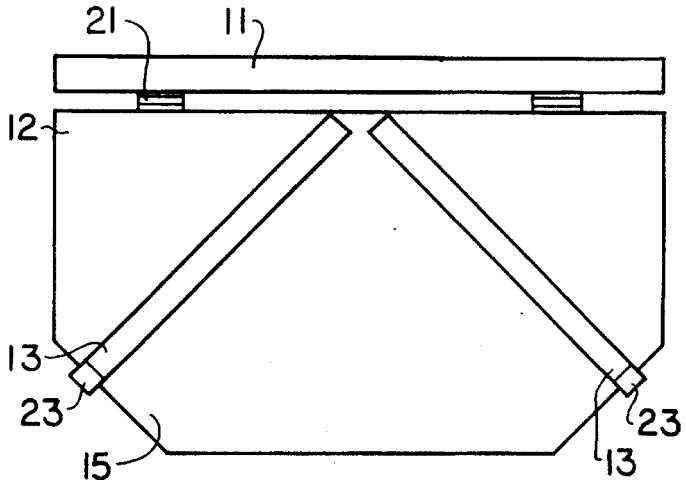
FIG 8
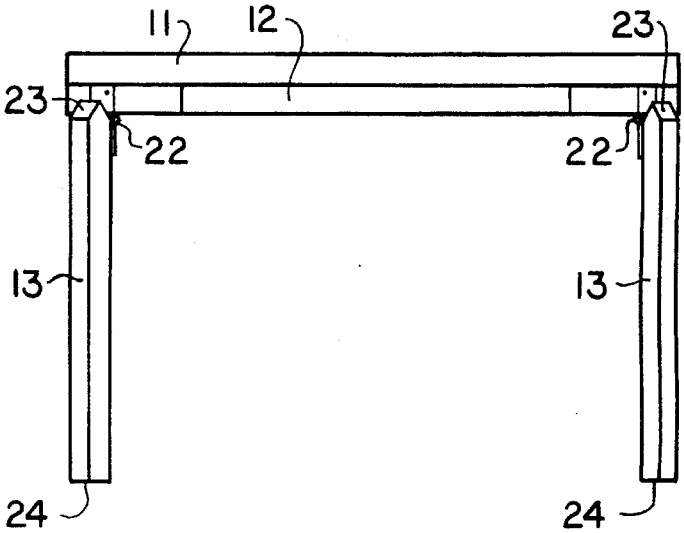
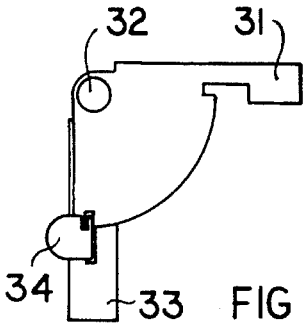
FIG 9

RAIL MOUNTED TABLE ROTATABLE ABOUT A LONGITUDINAL EDGE

BACKGROUND OF THE INVENTION

1. Field of the Invention

The general field of the present invention is horizontally disposed planar structures, ie. tables, more particularly tables having one edge attached to a rigid support structure and specifically tables so attached by means enabling rotation about a horizontal axis.

2. General Background

Decks attached to an exterior side of a house are typically constructed of weather resistant lumber and possess a length along the side of the house which exceeds the width extending from the house. This arrangement conspires against the use of tables possessing a circular, square, hexagonal or other shape wherein the width is equivalent to the length since seating about such a table will effectively block passage upon the deck about the table. Most tables which possess weather resistance are furthermore typically constructed in plastic or another material which is inconsistent with the weather resistant lumber of which tire deck is constructed and therefor detracts aesthetically from the deck.

Since a deck normally lacks a roof, any table left upon the same is subject to the damage associated with various forms of precipitation. It is inconvenient to dispose a table so that it will not be harmed by the elements. Removal of a table from the deck requires an alternative space in a protected area as well as the effort involved in transportation. This is contrary to the purpose of a deck which largely is relaxation outside the confines of four walls convenient to the amenities inside said four walls. The use of a deck obviously varies with the season and in pleasant weather will typically involve daily use. Removal of a table from the deck upon a daily basis is a gross inconvenience yet leaving a table upon a deck which obstructs movement about the same is also an inconvenience and an invitation to weather damage or substantial maintenance to avoid such damage.

Similarly, rooms inside a building frequently occasion an exigency of floor space which prohibits location of a table, desk or work bench. A child's bedroom, for example, often lacks sufficient space for a full desk which may also be considered expensive in terms of finance as well as floor space in consideration of the limited use expected of it. Another commonplace involves the widespread desire of many people to have a stable uncluttered surface upon which occasional carpentry, household repair, hobby modeling and other various activities may be performed without sacrifice of floor space when such activity is not being pursued. Other similar instances may be readily imagined in a commercial environment such as any office wherein the floor space necessary for a table is not conveniently available.

STATEMENT OF NEED

In consideration of the purposes and construction of most typical decks attached along the side of a house as discussed above, it becomes clear that a table which could be permanently stored upon an exterior deck but be not subject to weather damage and which would conform aesthetically with the deck, require minimal maintenance and would provide adequate seating without obstructing passage around the table upon the deck would provide a great convenience to the owners and users of such decks.

For the same reasons of convenience and exigencies of floor space in an interior room, residential or commercial, it is often desired that a stable horizontal surface exist for occasional use which does not merit the expense in either finance or sacrifice of floor space necessary for a desk, table or work bench.

Because there exists at present no such table meeting the requirements outlined above which are particular to an exterior deck attached to the side of a house, or which will afford a stable horizontal surface for occasional usage without taking up floor space while idle, a need therefore exists for a table which is adapted to the particular requirements of an exterior deck or interior room wherein an exigency of floor space and/or financial expense is concerned.

SUMMARY OF THE INVENTION

The object of the present invention is to provide a structure which will function as a substantially horizontal planar surface in a utility position and which will hang vertically from a longitudinal rotatable attachment in a storage position. A table, comprising a rigid structure possessing top and bottom substantially planar surfaces and means for substantially horizontal and substantially vertical orientations is considered. The table possesses a planar length and width and a longitudinal, rotatable attachment along one longitudinal edge to a rigid rail intended for substantially horizonal disposition upon a substantially vertical mounting surface. Upon the bottom substantially planar surface proximate each opposed lateral edge further proximate the side of the table opposed to the longitudinal edge possessing rotatable attachment to the rail, two rigid extensions, ie. legs are rotatably attached to the table.

In a utility position the table is disposed in a substantially horizontal disposition and both legs are disposed substantially perpendicular to the bottom planar surface with one end distal the rotatable attachment in contact with a floor and the rotatable attachment to the table being proximate the opposed end of the leg. The legs thus provide support of the side of the table which is opposed to the side of the table supported by the longitudinal, rotatable attachment to the rail. Each leg may be rotated about the attachment to the table so that both legs are disposed substantially parallel to and flush with said bottom surface. The table is then free to hang from the longitudinal rotatable attachment to the rail in a substantially vertical position.

Means for holding both legs in both the open and closed positions are suggested. The width of the table is of a lesser dimension than the length and must furthermore be less than the height of the table in order obtain the substantially vertical storage position which minimizes the floor space required when the table is not in use. The longitudinal orientation with respect to the rail furthermore optimizes the support obtainable from a horizontally mounted rail as well as optimizing utilization of floor space in regard to seating at a table.

BRIEF DESCRIPTION OF THE DRAWINGS

FIG. 3 is a plain elevational view taken from the front of an embodiment of the principles relating to the present invention illustrating means for holding both legs substantially perpendicular to the table top bottom surface.

FIG. 4 is a plain elevational view taken from the back of an embodiment of the principles relating to the present invention illustrating means for holding both legs substantially parallel to a table.

FIG. 5 is a plain elevational view of the underside of an embodiment of principles related to the present invention depicting a table of sufficient length to permit alignment of legs in a closed, storage position.

FIG. 6 is a plain elevational view taken from the side of an alternative embodiment of the principles related to the present invention illustrating a table in a vertical storage position.

FIG. 7 is a plain elevational view taken from the back of the alternative embodiment of the principles related to the present invention depicted in FIG. 6 illustrating a table in a vertical storage position.

FIG. 8 is a plain elevational view taken from the front of an alternative embodiment of the principles related to the present invention depicted in FIGS. 6–7 illustrating a table in the horizontal utility position.

FIG. 9 is a plain elevational view taken from the side of an preferred means of effecting a lateral rotatable attachment of leg to table top possessing locking perpendicular and parallel positions.

DETAILED DESCRIPTION OF THE INVENTION

Figure 1:
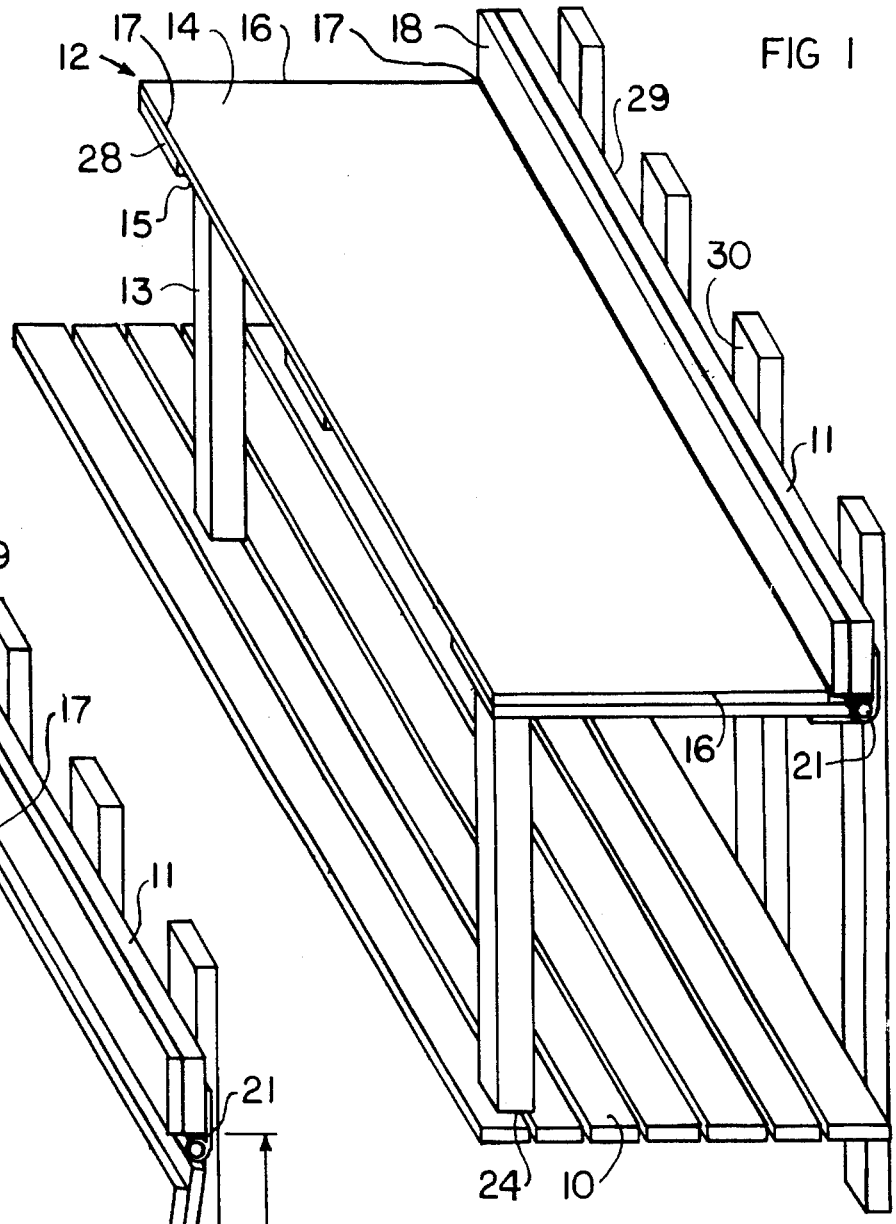
FIG. 1 is a perspective view of an embodiment of the principles relating to the present invention illustrating a rail mounted table in a horizontal use position.
Figure 2:
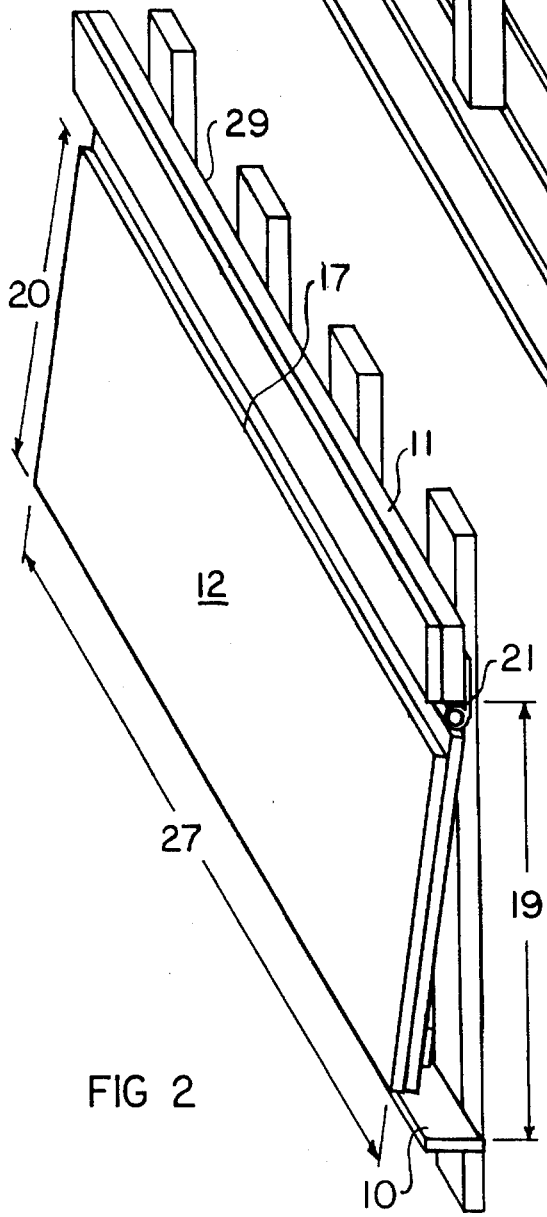
FIG. 2 is a perspective view of an embodiment of the principles relating to the present invention illustrating a rail mounted table in a vertical storage position.

FIG. 1 depicts an exterior residential deck possessing a floor 10 and a substantially vertical rigid structure 30 upon which a substantially horizontal rail 11 is mounted which supports a table top 12 in a horizontal utility position with two legs 13 in an extended utility position. The table possesses upper 14 and lower 15 substantially planar surfaces and one pair each of opposed lateral 16 and longitudinal 17 edges. Mounted parallel to the rail and one longitudinal edge is a vertically disposed 'splash board' 18. The height 19 of the table, as seen in FIG. 2 is determined by the position of the horizontal rail 11 relative to the floor 10 and both it and the length of the legs must be at least as great as the width 20 of the table. Horizontally disposed along the rail 11 and one longitudinal edge 17 of the table top 12 is a set of hinges comprising a longitudinal, rotatable attachment 21 of table to rail which supports the table.

FIG. 2 depicts the same table in storage position; the legs are in a closed position substantially parallel to and flush with the lower planar surface of the table top 12 which hangs from the horizontally disposed rail 11 by the longitudinal rotatable attachment 21 which enables the table top 12 to be rotated about a longitudinal axis parallel and proximate to the rail 11 through an arc comprising one quarter of a circle or ninety degrees between the horizontal utility position depicted in FIG. 1 and the vertical storage position depicted in FIG. 2 and vice versa, from the vertical storage position upwards to the horizontal utility position.

In the horizontal utility position depicted in FIG. 1 the two legs 13 are both positioned substantially perpendicular to the bottom surface 15 of the table top 12. Each leg 13 comprises a rigid extension possessing two ends, one proximate the table and possessing a laterally rotatable attachment 22 to the table top 12, preferably to the bottom surface 15. This lateral rotatable attachment 22 seen in FIG. 3 of one end of each leg 13 to the table top 12 must enable rotation of the leg with respect to the bottom substantially planar surface 15 of the table top 12 through an arc comprising one quarter of a circle or ninety degrees from perpendicular, as seen in FIG. 1, to parallel the bottom surface as seen in FIG. 2 and vice versa, from parallel to perpendicular. A preferred embodiment employs a hinge as the means of lateral rotatable attachment 22, said hinge possessing a length substantially equivalent to the width of the leg at the end proximate the table.

As seen in FIGS. 3–4, the axis of the lateral rotatable attachment 22 of both legs 13 to the table top 12 is substantially perpendicular to the longitudinal edges 17 of the table and proximate the bottom surface 15 of the table top 12. One said axis is set back from the longitudinal edge 17 opposed to the rail 11 a distance substantially equal to the width of the leg end and the other said axis is set back from said longitudinal edge 17 a distance substantially equivalent to twice the width of either leg 13. As clearly seen in FIG. 3, this disposition enables each leg 13 to be closed flush to the bottom surface 15 in parallel and partial overlap with each other as the length of each leg which is substantially equivalent to the height 19 of the table in this case exceeds half of the length 27 of the table top 12 as shown in FIG. 2.

Disposition of the axis of the lateral rotatable attachment 22 of each leg 13 to the table top 12 upon the bottom surface 15 such that the leg top surface 23 shown in FIG. 4 is in full contact with said bottom surface 15 in the utility position depicted in FIG. 1 is useful in gaining stability. It is important that the table top 12 be adequately supported by the longitudinal rotatable attachment 21 along one longitudinal edge 17 and by the legs 13 in the substantially horizontal utility position. Placement of the two legs proximate the corners between the longitudinal edge 17 opposite the longitudinal edge 17 attached to the rail 11 and the lateral edges 16 as shown in FIG. 5 optimizes the stability of the table in the utility position by ensuring that the center of gravity of any load placed upon the table top surface 14 will be located between the line of support given by the longitudinal rotatable attachment 21 to the rail 11 and the two areas of support given by the legs 13. Substantially full surface contact between the top surface 23 of each leg 13 and the bottom surface 15 of the table top 12 also is significant in regard to attaining maximum stability of the table in the utility position and hence these two aspects in regard to the disposition of each leg 13 with respect to the table top 12 are considered significant to a preferred embodiment of the principles relating to the present invention.

It is recognized that the height 19 of the table top 12 seen in FIG. 2 as determined by the distance between the substantially horizontal positioning of the longitudinal rotatable attachment 21 and the floor 10 be at least as great as the width 20 of the table top 12 in order to allow the table to hang in a vertical position for storage thus minimizing the floor area occupied in this state and to present a minimum surface area of table in a horizontal disposition to minimize the affects of precipitation if deployed in an outdoors environment such as an exterior residential deck. Given a substantially horizontal utility position as seen in FIGS. 1, 3 & 8, the legs 13 must possess a length substantially equal to the height 19 as defined directly above as shown in FIG. 2 and will therefore exceed in linear dimension the width 20 of the table top 12. Placement of hinges which may comprise the lateral rotatable attachment 22 substantially parallel to the longitudinal edges 17 so that the legs 13 would rotate in an arc parallel with the lateral edges 16 would be problematic, necessitating accommodation of the length of the legs exceeding the width of the table in some space within the rail 11. While this arrangement is tenable and is encompassed by the principles relating to the present invention, it is considered awkward.

Similarly, the legs 13 might be disposed along with the lateral rotatable attachment 22 such that in the closed position each leg is disposed at an angle to the longitudinal edge 17 proximate the longitudinal rotatable attachment to the rail 11, as shown in FIGS. 6–8 which illustrate an alternative embodiment of the principles relating to the present invention including table edges which are neither longitudinal nor lateral as depicted in the embodiments illustrated in FIGS. 1–5. Neither the disposition of the legs nor the use of table edges formed at an angle other than perpendicular and parallel to the longitudinal disposition of the rail 11 is recommended but instead serve as an example of variation of certain parameters within the scope of the principles relating to the present invention.

Another aspect of the present invention allowing considerable variance in structure concerns the manner in which the legs 13 support the table top 12 in a utility position. In the utility position as shown in FIGS. 1 & 3, the leg top surface 23 shown in FIG. 4 is butted against the substantially planar bottom surface 15 of the table top 12 and therefore said leg top surface 23 is presumed to be flat, possessing a substantially planar surface perpendicular to the longitudinal axis of the leg. As seen in FIG. 4, this leg top surface 23 is indeed flat as suggested for abutment against the table bottom surface 15. The reason for this preferred manner of construction is mechanically obvious, however, adherence to the principles relating to the present invention does not demand such a construction.

As seen in FIGS. 6–8 each leg top surface 23 has neither a planar surface perpendicular to the axis of the leg nor does it have contact with the bottom surface 15 or any other part of the table top 12. It is also noteworthy that the hinge comprising means of lateral rotatable attachment 22 of the leg 13 to the table top 12 is attached to an edge of the table and not to the bottom surface 15 as depicted in FIGS. 1–5. In this case the load upon the table is supported by the screws securing the hinges to the table and to the legs and while this is considered to lack the inherent strength of the preferred arrangement butting each top leg surface 23 against the table bottom surface 15, this alternative embodiment of the principles relating to the present invention will certainly work quite well in practice if attention is given to the strength of the attachment of the hinge to both the legs and the table and to the hinge itself.

In addition to the structure and variation therein discussed above, it is considered desirable to include means of maintaining or locking both legs in either the extended or closed position. Such means are wholly unnecessary to fulfillment of the principles relating to the present invention but are certainly in accordance with the same. Given the table depicted in FIG. 1 without any means for maintaining the perpendicular position of both legs 13 with respect to the bottom surface 15 of the table top 12, it is readily imagined that the table so depicted is fully functional and inherently stable as long as the only load placed upon the table comprise forces directed downward which will generally be the case in the intended use of the table. However, if a force directed inward were to be given upon the lower portion of the surface of a leg 13 which is substantially flush the lateral edge 16 and opposite the side rotatably attached to the table top 12, it is readily imagined that the stability of the structure might readily be compromised.

It is therefore considered desirable to provide means of securing both legs 13 in the utility position, perpendicular to the bottom planar surface 15 of the table top 12. This is easily achieved by placement of a captured slidable pinion engaging an apertured second piece commonly known as a barrel lock 25 as depicted in FIG. 3 that may be thrown into a cavity in the floor 10. The routinier may readily devise other means of maintaining the legs in the utility position and therefore it is understood that the barrel lock depicted serves as an example of any such means.

Similarly, while it is not considered to be as important to maintain the legs 13 in a closed storage position substantially parallel to and flush with the table bottom surface 15, such means are considered desirable, especially during the action of lowering the table about the longitudinal rotatable attachment 21 from the utility portion depicted in FIG. 1 into the vertical storage position depicted in FIG. 2. The same pair of pair of barrel locks 25 as seen in FIG. 4 engage a pair of hooks 26 attached to the bottom surface 15 of the table top 12, again serving as an example of means for maintaining the legs in a closed position substantially parallel to and flush with the bottom surface of the table top. One alternative to the use of barrel locks would be clips shaped to exert pressure upon the two opposed sides of the legs perpendicular the bottom surface 15 when in a closed position and indents appropriately located upon the appropriate leg surfaces would make this approach quite effective.

The means considered to be best for locking the legs in both the utility and storage positions, perpendicular to and parallel to, respectively, the substantially planar bottom surface of the table top is illustrated in FIG. 9 which depicts a locking hinge. This locking hinge is comprised of a first member 31, a second member 33, a cylinder 32 and a spring loaded lock bar 34. The first member possesses two substantially parallel and identical sides comprising substantially flat plates with an arcuate edge encompassing ninety degrees with a notch at both ends, as seen clearly in FIG. 9. It is hinged to the second member 33 by the cylinder 32 which is disposed perpendicular to the two parallel sides of the first member 31 at the center of the arcuate portion.

The locking bar 34 is notched at either end and spring biased in attachment to the second member 33 into either of the two notches delineating the ninety degree arc of the first member 31 which coincides with the difference between the utility and storage positions of the legs of the present invention with relation to the bottom surface of the table top. Release is effected by pushing the head of the locking bar 34 inward, against the pressure of the interior spring, thus aligning both notches in the bar with the arcuate plates and allowing movement of the bar along the arc and of the second member with relation to the first member.

As regards the distal end 24 of the leg 13 when in the utility position as depicted in FIGS. 1, 3 & 8, it is fairly obvious that said end preferably be flat and perpendicular the longitudinal axis of the leg because it is expected that the deck 10 will be comprise a substantially flat, planar surface. A typical exterior residential deck is constructed of weather resistant lumber disposed in parallel and spaced such that a small gap between the planks is obtained for purposes of drainage. It is considered that an embodiment of the principles relating to the present invention also be best constructed of similar material, preferably a weather resistant wood such as pressure treated pine, spruce, et cetera or, most preferably, naturally resinous and weather resistant wood such as cedar or redwood. It further is recommended that construction for exterior use include use of corrosion resistant hardware, ie. hinges and barrel locks made of brass, stainless steel or possessing a corrosion resistant plating or galvanization or other surface treatment effecting corrosion resistance.

Corrosion and weather resistance is, of course, of far lesser concern for construction intended for interior usage. Lumber, which is opposed to composite wood derived material commonly known as particle board, is still preferred for construction of a table intended for interior usage which adheres to the principles relating to the present invention. Those practiced in the art would not consider particle board construction for exterior usage and will readily recognize the superiority of lumber over composite wood board in most aspects. Composite wood board is considerably heavier than most lumber and this is a significant consideration in the construction of a device which is intended to be rotated about a longitudinal axis virtually every time it is used. Composite board also lacks rigidity, durability and most particularly, strength in attachment by wood screw to hardware in comparison with lumber. It is therefore generally preferred that lumber in opposition to composite wood board be employed in construction of a device in accordance with the principles relating to the present invention whether said device is intended for exterior or interior usage.

It is essential to the principles relating to the present invention that a longitudinal or lengthwise edge 17 of file rigid structure possessing two substantially parallel planar surfaces called a table top 12 possess a longitudinal rotatable attachment 21 to a rigid structure possessing at least one substantially flat surface possessing a length much greater than width hereby defining a 'rail' 11 for the purposes of the present document. The rail is thus an essential element of the present invention. If a device constructed in accordance with the principles relating to the present invention is intended for interior use, it is expected that the rail 11 will be attached preferably by means of wood screws to the studs backing an interior vertical wall. If exterior usage is intended, the rail must be attached to a substantially vertical rigid surface in an appropriate manner.

The rail might simply be nailed or screwed to an exterior wall. More typically, it is envisaged that the rail will be attached to a substantially vertical railing of an exterior deck either by directly screwing or nailing the rail to vertical support members of the railing or, preferably, by means of bolts which pass through an opening in the railing alongside said vertical support members of the railing and through a second rail located parallel to the first on the opposed side of the railing, thereby avoiding any penetration of the structure comprising the railing or the rigid substantially vertical structure to which attachment is thus made. It is considered that the owner of a device constructed in accordance with the principles relating to the present invention may well change residence and wish to take said device along to the new residence without having marred the relatively permanent structure of the exterior deck railing of the first residence. If said device is taken from an interior location, the holes in the drywall or plaster necessary for attachment to the backing studs will of course require patching if the device is to be removed without marring the appearance of the interior wall involved.

Other preferred details in construction are seen in FIGS. 1–2 related to the use of the optional 'splash board' 18 mentioned above. Since the means of longitudinal rotatable attachment 21 of the table top 12 to the rail 11 will in all likelihood be visible and aesthetically unpleasing, appropriate positioning of a cover or splash board 18 will serve to hide the hardware used in this attachment from general sight. This additional cover or splash board 18 will also serve, as readily envisaged from FIG. 1 to contain spills upon the top surface 14 of the table top 12 and to protect said top surface from wind which is of obvious practical value while dining, among other activities.

As clearly seen in FIGS. 1–2, the hinges comprising means of longitudinal rotatable attachment 21 are attached to the rail 11 which is directly behind and flush to the splash board 18. Said hinges 21 are each further attached to a laterally oriented board 28 underlying the boards comprising the top surface 14 of the table top 12 and protrude slightly beyond the meeting of the same with the splash board 18. The thickness of the splash board 18 accommodates the protrusion of these underlying lateral boards 28 from the top surface 14 which thus meets the exposed surface of the splash board 18 in the utility position as depicted in FIG. 1 hiding the hinges 21 which are visible in the storage position depicted in FIG. 2. The splash board 18 in this preferred embodiment of the principles relating to the present invention is attached by means of wood screws passing through the thickness of the rail 11 and are hence invisible to view from the table top 12. If a second, backing rail is to be deployed to avoid marring the railing of an exterior deck, it is advised that the rail 11 be countersunk to accommodate the heads of the bolts utilized in attaching the two rails together in compression against the vertical support members of the railing so that a splash board 18 may be positioned substantially flush to the rail 11 as seen in FIGS. 1–2.

One of the principle benefits derived from construction of a device in accordance with the principles relating to the present invention is enablement of seating at a table facing the longitudinal rotatable attachment means 21, which in the case depicted in FIGS. 1–2, allows seating facing outward from an exterior residential deck. This is considered highly desirable in light of typical exterior residential deck construction and usage thereof wherein said decks are often relatively narrow, being constructed along an exterior wall and typically are employed for dining in pleasant weather. A length 27 greater than the width 20 shown in FIG. 2 is therefore expected as a typical feature of a device constructed in accordance with the principles relating to the present invention although this relation is not necessary to fulfillment of the same.

It is necessary that the height 19 of a table constructed in accordance with the principles relating to the present invention be somewhat greater than the width 20. A typical table height is approximately thirty inches and a useful width will accordingly measure between twenty and thirty inches. Assuming a linear dimension of between twenty-four and twenty-eight inches as accommodative of the width required for comfortable seating it is readily deduced that a table length of at least forty-eight inches or four feet is desired to accommodate two seatings along the length of a table. Assuming a minimum height of twenty-eight inches, a minimum length of sixty inches or five feet is required of a table in accordance with the principles relating to the present invention that will enable positioning of the legs 13 in a closed position as seen in FIG. 5, including one and a half inches width of the leg top surface 23 and an inch clearance between the two leg distal ends 24.

Since it is undesirable to have a leg centered between or otherwise substantially medial to the lateral edges 16 of a table top 12 owing to the annoyance such an obstruction occasions in seating along the free longitudinal edge 17 of such, it is considered that a practical limit of approximately six feet in length 27 exists for construction of a device in accordance with the principles relating to the present invention possessing two legs 13. It is therefore considered preferable to arrange a pair of such tables adjacent longitudinally in order to obtain increased seating capacity. This approach will also provide greater flexibility in regard to both seating capacity as well as in marketing and installation of such devices in stages as desired in what may be considered 'modular' units thereby allowing production upon a single standard sizing.

These considerations complete what is regarded as a full disclosure of the best means of making and using a device constructed in accordance with the principles relating to the present invention including preferred embodiments as well as a full discussion of the rationale underlying the design and function of the same. Furthermore, the foregoing discussion is meant to provide a comprehensive context to facilitate a thorough understanding of the principles relating to the present invention and is not to be regarded in any manner as restricting the extent of the intellectual property secured by Letters Patent for which I hereby claim:

I claim:

1. A table intended for mounting upon a substantially vertical rigid structure further intended to possess a substantially horizontal utility position and a substantially vertical storage position, said table comprising:

a table top, a rail, a longitudinal rotatable attachment between said table top and said rail and two legs each comprising a rigid extension possessing two opposed ends;

said table top comprising a rigid structure possessing a longitudinal length and a lateral width, one substantially planar top surface and one substantially planar bottom surface further possessing at least one longitudinal edge proximate said longitudinal rotatable attachment;

said rail comprising a rigid member possessing at least one substantially planar face possessing a length and width, said length exceeding in dimension said width, said longitudinal rotatable attachment being longitudinally affixed to said planar surface;

each said leg possessing a lateral rotatable attachment to a portion of said table top distal said one longitudinal edge and proximate one said end of the leg, the other said end of each said leg being distal said lateral rotatable attachment, each said leg further possessing a length of a dimension at least as great as the dimension of said lateral width of said table top, said lateral rotatable attachment further maintaining each of said two legs in substantially perpendicular disposition with respect to said table top bottom surface;

each said lateral rotatable attachment comprising a locking hinge comprising a first member and a second member, a cylinder and a spring loaded locking bar, said first member possessing two substantially parallel flat sides each possessing an arcuate edge bounded by two notches encompassing ninety degrees, said locking bar being attached to said second member and biased by a spring into one of said two notches upon each side of said first member, said first and second members being rotatably attached by said cylinder which is disposed perpendicular to both said sides of said first member at the center of the arc defining said arcuate edge;

each said lateral rotatable attachment enabling each said leg to be rotated with respect to said substantially planar bottom surface of said table top through a full arc of ninety degrees bounded by a perpendicular disposition between said leg and said substantially planar bottom surface and a substantially flush, substantially parallel disposition between said leg and said substantially planar bottom surface;

said longitudinal rotatable attachment enabling said table top to be rotated with respect to said substantially planar surface of said rail through a full arc of ninety degrees bounded by a perpendicular disposition between said substantially planar top surface and said substantially planar surface of said rail and a substantially parallel disposition between said substantially planar bottom surface and said substantially planar surface of said rail;

said table thereby possessing the capability of being mounted to a substantially vertical rigid structure by attachment of said rail to the same and disposed in a substantially horizontal position such that said longitudinal rotatable attachment is disposed at a distance from a floor substantially equivalent to the length of each said leg and said table top may be supported in a substantially horizontal position by said longitudinal rotatable attachment and said two legs disposed substantially perpendicular to said substantially planar bottom surface;

said table further possessing the capability of being disposed in said substantially vertical storage position wherein each said leg is disposed substantially flush with and parallel to said substantially planar bottom surface which is disposed substantially parallel to said planar surface of said rail thereby minimizing the floor space occupied by said table in said storage position.

2. The table of claim 1 further including a board disposed substantially parallel to and flush with said rail further possessing rigid attachment to said rail and a longitudinal edge disposed proximate and parallel to said longitudinal edge of said table top proximate said longitudinal rotatable attachment when said table top is disposed in said utility position.

3. The table of claim 1 wherein said means for maintaining each of said two legs in substantially perpendicular disposition with respect to said table top bottom surface comprises a barrel lock device.

4. The table of claim 1 further including means for maintaining each of said two legs in substantially parallel disposition with respect to said table top bottom surface.

5. The table of claim 4 wherein said means for maintaining each of said two legs in substantially parallel disposition with respect to said table top bottom surface comprises a barrel lock device.

6. The table of claim 1 wherein said means of lateral rotatable attachment is affixed to said table top substantially planar bottom surface.

7. The table of claim 6 wherein each said leg end proximate said means of lateral rotatable attachment possesses a substantially flat planar surface substantially perpendicular the direction of the extension of said leg.

8. The table of claim 7 wherein said substantially flat planar surface of each said leg end proximate said means of lateral rotatable attachment is disposed in substantially flush contact with said table top bottom surface in said utility position wherein each said leg is disposed substantially perpendicular to said table top bottom surface.

9. The table of claim 1 possessing first and second opposed longitudinal edges substantially parallel each other and set apart from each other a distance substantially equivalent to said width of said table top, said first longitudinal edge being substantially parallel to and proximate said substantially planar face of said rail.

10. The table of claim 9 wherein said means of lateral rotatable attachment possesses an axis which is disposed substantially perpendicular both said longitudinal edges.

11. The table of claim 10 wherein a first said means of lateral rotatable attachment is disposed in immediate proximity to said second longitudinal edge and a second said means of lateral rotatable attachment is set back from said second longitudinal edge a distance at least as great as the width of the leg possessing said first lateral rotatable attachment and each said leg possesses a length greater than on half of said length of said table top, said two legs thereby possessing means of being disposed substantially parallel to and flush with said table top bottom surface wherein a portion of each said leg distal said means of lateral rotatable attachment is disposed in substantially parallel and proximate relation to the other said leg portion distal said means of lateral rotatable attachment.

12. The table of claim 9 wherein said means of lateral rotatable attachment for each said leg is disposed in immediate proximity of said second longitudinal edge and said length of said table exceeds in dimension the sum of the lengths of both said legs, said table thereby possessing means of disposing both said legs substantially flush and parallel to said table top bottom surface wherein each said leg is aligned with each other.

13. The table of claim 9 wherein said table top further possesses first and second lateral edges disposed substantially parallel to each other and set apart from each other a distance substantially equivalent to said length of said table top.

14. The table of claim 13 wherein both said first and said second lateral edges meet both said first and said second longitudinal edges in a substantially perpendicular carrier.

15. A table intended for mounting upon a substantially vertical rigid structure further intended to possess a substantially horizontal utility position and a substantially vertical storage position, said table comprising:

a table top, a rail, a longitudinal rotatable attachment between said table top and said rail and two legs each comprising a rigid extension possessing two opposed ends;

said table top comprising a rigid structure possessing a longitudinal length and a lateral width, one substantially planar top surface and one substantially planar bottom surface further possessing at least one longitudinal edge proximate said longitudinal rotatable attachment;

said rail comprising a rigid member possessing at least one substantially planar face possessing a length and width, said length exceeding in dimension said width, said longitudinal rotatable attachment being longitudinally affixed to said planar surface;

each said leg possessing a lateral rotatable attachment to a portion of said table top distal said one longitudinal edge and proximate one said end of the leg, the other said end of each said leg being distal said lateral rotatable attachment, each said leg further possessing a length of a dimension at least as great as the dimension of said lateral width of said table top, said lateral rotatable attachment further maintaining each of said two legs in substantially parallel disposition with respect to said table top bottom surface;

each said lateral rotatable attachment comprising a locking hinge comprising a first member and a second member, a cylinder and a spring loaded locking bar, said first member possessing two substantially parallel fiat sides each possessing an arcuate edge bounded by two notches encompassing ninety degrees, said locking bar being attached to said second member and biased by a spring into one of said two notches upon each side of said first member, said first and second members being rotatably attached by said cylinder which is disposed perpendicular to both said sides of said first member at the center of the arc defining said arcuate edge;

each said lateral rotatable attachment enabling each said leg to be rotated with respect to said substantially planar bottom surface of said table top through a full arc of ninety degrees bounded by a perpendicular disposition between said leg and said substantially planar bottom surface and a substantially flush, substantially parallel disposition between said leg and said substantially planar bottom surface;

said longitudinal rotatable attachment enabling said table top to be rotated with respect to said substantially planar surface of said rail through a full arc of ninety degrees bounded by a perpendicular disposition between said substantially planar top surface and said substantially planar surface of said rail and a substantially parallel disposition between said substantially planar bottom surface and said substantially planar surface of said rail;

said table thereby possessing the capability of being mounted to a substantially vertical rigid structure by attachment of said rail to the same and disposed in a substantially horizontal position such that said longitudinal rotatable attachment is disposed at a distance from a floor substantially equivalent to the length of each said leg and said table top may be supported in a substantially horizontal position by said longitudinal rotatable attachment and said two legs disposed substantially perpendicular to said substantially planar bottom surface;

said table further possessing the capability of being disposed in said substantially vertical storage position wherein each said leg is disposed substantially flush with and parallel to said substantially planar bottom surface which is disposed substantially parallel to said planar surface of said rail thereby minimizing the floor space occupied by said table in said storage position.

* * * * *